US009463969B2

(12) United States Patent
Hartley

(10) Patent No.: US 9,463,969 B2
(45) Date of Patent: Oct. 11, 2016

(54) RIGID OUTER CONTAINER FOR RELEASABLY ACCOMMODATING A STAND-UP POUCH

(71) Applicant: Sonoco Development, Inc., Hartsville, SC (US)

(72) Inventor: Scott Huntington Hartley, Columbia, SC (US)

(73) Assignee: Sonoco Development, Inc., Hartsville, SC (US)

( * ) Notice: Subject to any disclaimer, the term of this patent is extended or adjusted under 35 U.S.C. 154(b) by 82 days.

(21) Appl. No.: 14/485,128

(22) Filed: Sep. 12, 2014

(65) Prior Publication Data

US 2016/0075547 A1 Mar. 17, 2016

(51) Int. Cl.
*B67D 3/00* (2006.01)
*B65D 77/06* (2006.01)

(52) U.S. Cl.
CPC ..... *B67D 3/0067* (2013.01); *B65D 77/068* (2013.01)

(58) Field of Classification Search
CPC .... B67D 3/0067; B65D 25/54; B65D 31/16; B65D 33/004; B65D 33/01
USPC ..... 222/92, 94, 105, 131, 183; 220/601
See application file for complete search history.

(56) References Cited

U.S. PATENT DOCUMENTS

| | | | | |
|---|---|---|---|---|
| 3,233,817 | A * | 2/1966 | Casady | B65D 77/065 222/105 |
| 4,214,675 | A * | 7/1980 | Schmit | B65D 5/748 222/105 |
| 5,788,121 | A | 8/1998 | Sasaki et al. | |
| 6,142,344 | A | 11/2000 | Kai | |
| 6,419,118 | B1 | 7/2002 | Rees et al. | |
| 6,510,965 | B1 | 1/2003 | Decottignies | |
| 2003/0075560 | A1* | 4/2003 | Lee | B65D 75/5822 222/92 |
| 2003/0192909 | A1 | 10/2003 | Maskell | |
| 2006/0071021 | A1* | 4/2006 | Steeves | B65D 77/065 222/105 |
| 2007/0133909 | A1 | 6/2007 | Arvizu | |
| 2008/0083777 | A1* | 4/2008 | Lips | B65D 77/067 222/105 |
| 2011/0220652 | A1 | 9/2011 | Corbett et al. | |
| 2012/0168461 | A1 | 7/2012 | Topits et al. | |
| 2014/0131398 | A1* | 5/2014 | Bardet | B65D 47/06 222/567 |
| 2015/0024085 | A1* | 1/2015 | McBean | A61J 11/04 426/2 |

* cited by examiner

*Primary Examiner* — Donnell Long
(74) *Attorney, Agent, or Firm* — Miller, Matthias & Hull LLP

(57) ABSTRACT

A refillable package combination includes a stand-up pouch accommodated within an outer container that includes a hollow shell with an open bottom. The stand-up pouch is inserted through the open bottom and a corner spout of the pouch is inserted through an opening in a slanted corner panel of the hollow shell. Frictional engagement between the corner spout and the opening secures the spout to the corner panel and pouch within the hollow shell.

15 Claims, 3 Drawing Sheets

RIGID OUTER CONTAINER FOR RELEASABLY ACCOMMODATING A STAND-UP POUCH

BACKGROUND

1. Technical Field

This document discloses a rigid outer container for releasably accommodating a stand-up pouch that accommodates a product that can be dispensed through a corner spout of the stand-up pouch. The rigid outer container includes a slanted corner panel that releasably and frictionally receives the corner spout of the stand-up pouch.

2. Description of the Related Art

Many dry goods, like cereal, are sold in bags enclosed within a box. The bags are typically heat sealed at the top and the bottom of the bag and a "fin seal" extends along one side of the bags. These bags may be difficult to open, particularly if they are fabricated from a sturdy plastic material. Further, these types of bags typically do not have a built-in closure function. Thus, once the box and the bag are opened, the product is exposed to the atmosphere unless the consumer resorts to rolling the bag and/or using some sort of extraneous clamp or dip to help preserve the freshness of the product and to keep the product from spilling out of the bag.

On the other hand, stand-up pouches are a type of food package where the product is provided in a bag or pouch, which may have a gusseted bottom, so the pouch will stand upright on a shelf without a box. A top corner of the pouch may be removed to leave a hole that receives a threaded corner fitment, which serves as a spout through which the product is poured. A threaded cap is typically provided to close the spout. Stand-up pouches, or "SUPs," provide an excellent airtight and re-sealable package for many food products and SUPs are easy for consumers to open and use.

However, SUPs are easy to knock over when placed on a shelf, particularly if the shelf is ventilated. In a retail setting, some SUPs are displayed in a cardboard tray that keeps the SUPs upright and aligned in a single row to present a neat and orderly appearance for customers. In contrast, other SUN hang from a metal rod and are not placed a horizontal surface at all in the retail setting. After purchase, without the support of a tray or a rod, SUPs are easily knocked over when placed on a horizontal surface, thereby making the consumer's pantry or cabinet look disorganized and untidy.

While SUPs are popular and provide a convenient and air tight package for food, there is a need for a way to stabilize SUPs on a shelf or other horizontal surface so they don't tip over as easily and so multiple SUPs can be stored together in a neat and orderly fashion.

SUMMARY OF THE DISCLOSURE

In one aspect, this document discloses an outer container for receiving a stand-up pouch having a corner spout. The outer container may include a hollow shell with an open bottom. The hollow shell may include a slanted corner panel with an opening for mateably receiving the corner spout of the stand-up pouch. Further, the opening may be sized to frictionally receive the spout to secure the spout in place during use while permitting the spout and the stand-up pouch to be removed when the stand-up pouch is empty so it can be replaced.

In another aspect, this document discloses a refillable package. The disclosed refillable package may include a pouch having a top with a corner spout. The refillable package may further include a hollow shell with an open bottom for receiving the pouch. The hollow shell may further include a slanted corner panel with a opening for mateably receiving the corner spout of the pouch. Further, the refillable package may include a means for locking or securing the corner spout in the opening of the slanted corner panel.

In another aspect, this document discloses a refillable package that may include a stand-up pouch having atop with a slanted corner connected to a corner spout. The stand-up pouch may further include a gusseted bottom. The corner spout may include at least one flare and a flange spaced apart from the flare and disposed between the flare and the slanted corner. The refillable package may further include a hollow shell with an open bottom for receiving the stand-up pouch. The hollow shell may further include a slanted corner panel with an opening for mateable receiving the corner spout of the stand-up pouch. The slanted corner panel may be received between the flare and the flange after the corner spout and flare have been inserted through the opening from inside the hollow shell.

In any one or more of the embodiments described above, the hollow shell may include at least one window for exposing indicia printed on the stand-up pouch.

In any one or more of the embodiments described above, the hollow shell include at least one window for exposing an amount of product remaining in the stand-up pouch.

In any one or more of the embodiments described above, the means for locking the corner spout to the opening of the slanted corner panel may include the opening being sized to frictionally receive the corner spout.

In any one or more of the embodiments described above, the means for locking includes at least one flare disposed on the corner spout and the opening is sized to frictional receive the corner spout and flare when inserted through the opening from an interior of hollow shell to a position outside of the hollow shell. Further, the opening may further be sized to preclude the at least one flare from being pulled back through the opening from the position outside of the hollow shell without compressing the flare.

In any one or more of the embodiments described above, the flare may be compressible.

In any one or more of the embodiments descried above, the slanted corner panel has an inner surface and an outer surface and the opening in the slanted corner panel is defined by a sidewall that extends from the inner to the outer surface. The opening has a first diameter at the inner surface and a second diameter at the outer surface that is larger than the diameter at the inner surface so the sidewall of the opening is angled outwardly as it extends from the inner surface to the outer surface. As a result, it is easier to remove the stand-up pouch from the hollow shell by pulling the flare back through the opening from its position outside of the hollow shell.

In any one or more of the embodiments, the flare may be rounded to facilitate removal of the stand-up pouch from the hollow shell by pulling the flare back through the opening from its position outside of the opening.

In any one or more of the embodiments described above, the corner spout may include a flange spaced apart from the flare fir receiving a portion of the slanted corner panel that encircles the opening. The flange may have a diameter that is greater than the diameter of the opening, thereby precluding the flange from passing through the opening from an interior of the hollow shell.

In any one or more of the embodiments described above, the corner spout may include a distal end that is received in a cap. The cap may be connected to the flare by at least one tamper evident tab that breaks when the cap is removed from the spout.

In any one or more of the embodiments described above, the tab may be scored to facilitate breakage of the tab.

In any one or more of the embodiments described above, the tab may be notched to facilitate breakage of the tab.

The features, functions, and advantages discussed above may be achieved independently in various embodiments or may be combined in yet other embodiments, further details of which are explained below with reference to the drawings.

BRIEF DESCRIPTION OF THE DRAWINGS

For a more complete understanding of the disclosed methods and apparatuses, reference should be made to the embodiments illustrated in greater detail on the accompanying drawings, wherein.

The drawings are not necessarily to scale and illustrate the disclosed embodiments diagrammatically and in partial views. In certain instances, this disclosure may omit details which are not necessary for an understanding of the disclosed methods and apparatuses or which render other details difficult to perceive. Further, this disclosure is not limited to the particular embodiments illustrated herein.

DETAILED DESCRIPTION OF THE PRESENTLY PREFERRED EMBODIMENTS

Figure 1:
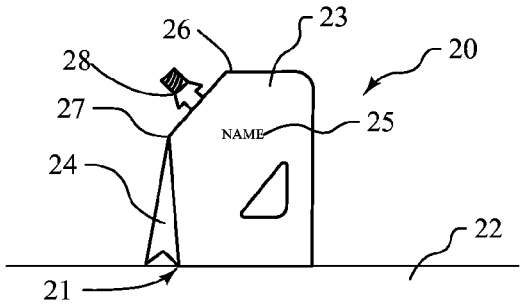
FIG. 1 is a perspective view of a stand-up pouch.

FIG. 1 illustrates a stand-up pouch 20 that includes a gusseted bottom 21 that enables the stand-up pouch 20 to stand upright on a horizontal surface 22. The stand-up pouch 20 also includes a front panel 23 that is disposed between a pair of side panels, only one of which is shown at 24 in FIG. 1. The stand-up pouch 20 also includes a rear panel (not shown). The front panel 23 may include indicia 25, such as a trademark, product description, ingredients, etc. The stand-up pouch 20 further includes a top edge 26 and a slanted corner 27. The slanted corner 27 is coupled to a spout 28, the details of which will be further explained below in connection with FIGS. 5-9.

Figure 2:
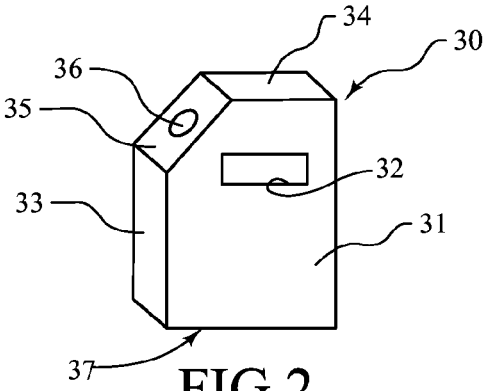
FIG. 2 is a perspective view of an outer container that receives the stand-up pouch of FIG. 1.
Figure 3:
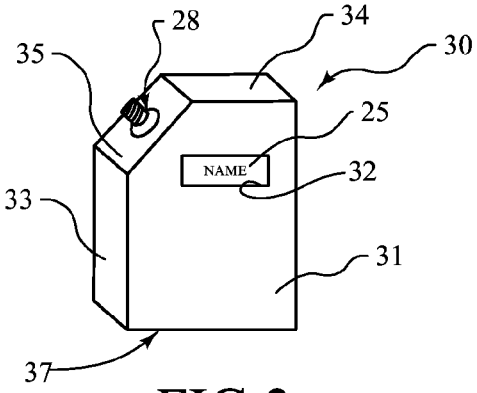
FIG. 3 is a perspective view of a refillable package that includes the outer container of FIG. 2 accommodating the stand-up pouch of FIG. 1.

FIG. 2 illustrates a rigid outer container 30. The outer container 30 is hollow and includes an open bottom 37 for receiving the stand-up pouch 20. The outer container 30 may also include a front panel 31 that may include a window 32 so that the consumer may view the indicia 25 disposed on the front panel 23 of the stand-up pouch 20, as shown in FIG. 3. The outer container 30 includes a pair of side panels, only one of which is shown at 33 in FIG. 2, as well as a top panel 34 and a slanted corner panel 35. A slanted corner panel 35 includes an opening 36 for accommodating the spout 28 of the stand-up pouch 20. Specifically, as shown in FIG. 3, the stand-up pouch 20 may be inserted through the open bottom 37 until part of the spout 28 extends through the opening 36 in the corner panel 35. The user then grasps the spout 28 and pulls it through the opening 36, which frictionally engages the spout 28 to secure the stand-up pouch 20 within the outer container 30.

Figure 4:
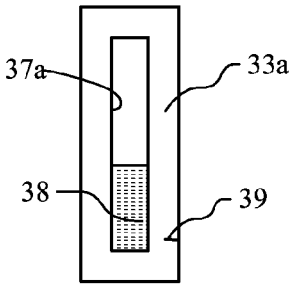
FIG. 4 is a left side plan view of the refillable package shown in FIG. 3.

FIG. 4 is a left side view of the outer container 30, particularly illustrating a side panel 33*a* that features a vertical window 37*a* that may be used by the consumer to determine how much product 38 is disposed within the stand-up pouch 20. The side panel 33*a* may also include indicia 39 that indicates when the product 38 is running low inside the stand-up pouch 20 and to further provide a reminder to the consumer to purchase another stand-up pouch 20 or more product 38.

Figure 5:
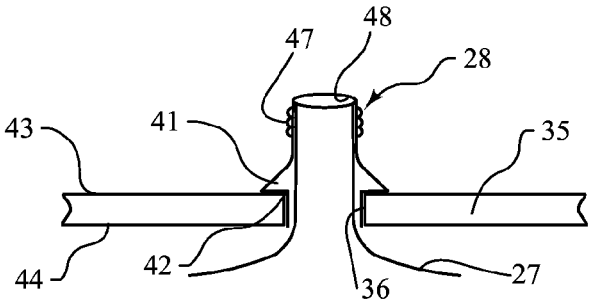
FIG. 5 is a partial sectional view of the spout and corner panel of FIG. 3, particularly illustrating a means for locking or securing the stand-up pouch to the outer container by way of a flare disposed on the spout that is compressed as it passes through the opening in the corner panel.

FIG. 5 illustrates a spout 26 that has been inserted through an opening 36 in a corner panel 35. To secure the spout 28 in the opening 36 and therefore the stand-up pouch 20 in place within the outer container 30, the spout 28 may include a flare 41. The flare 41 and the opening 36 are sized so that the flare 41 may be forced through the opening 36 until the lower edge 42 of the flare 41 rests on the outer surface 43 of the corner panel 35. In some embodiments, the inner surface 44 of the corner panel 35 may engage the slanted corner 27 of the stand-up pouch 20. Further, the flare 41 may be compressible to facilitate the insertion of the spout 28 through the opening 36 or removal of the spout 28 from the opening.

Figure 6:
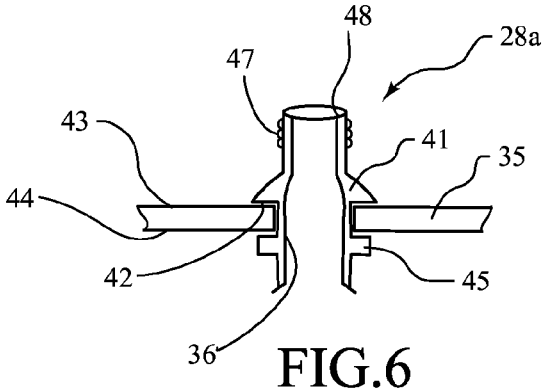
FIG. 6 is another partial sectional view of an alternative spout and corner panel, particularly illustrating the use of an inner flange that is spaced apart from the flare so that a portion of the corner panel that encircles the opening is received between the flare and the flange.

FIG. 6 illustrates another spout 28*a* that also includes a flare 41 as well as a flange 45 disposed opposite the corner panel 35 from the flare 41. The flange 45 enhances the locking relationship between the corner panel 35 and the spout 28*a* The flange 45 should have a diameter sufficiently large so as to prevent the flange 45 from being pulled through the opening 36 in the corner panel 35 as the spout 28*a* is inserted through the opening 36. Further, the flange 45 should be spaced apart from the lower edge 42 of the flare 41 to accommodate the corner panel 35 bets Teen the flare 41 and flange 45 as shown in FIG. 6.

Figure 7:
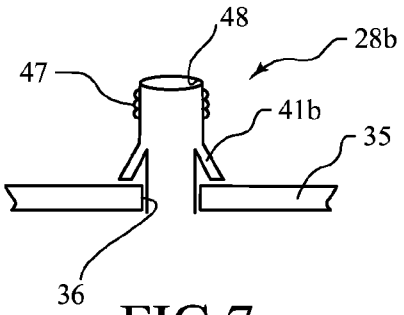
FIG. 7 is another partial sectional view of an alternative spout and flare as inserted through the opening in the corner panel.

FIG. 7 illustrates another spout 28*b* that is equipped with a flare 41*b* that may be more compressible than the flare 41 shown in FIGS. 5-6. The flares 41, 41*b* should be somewhat compressible to facilitate the insertion of the spouts 28, 28*a*, 28*b* through the opening 36 and removal of the spouts 28, 28*a*, 28*b* from the opening 36. The more compressible nature of the flare 41*b* may be appreciated by older consumers whose hands may not be strong enough to compress a more robust flare, such as the one shown at 41 in FIGS. 5-6.

Figure 8:
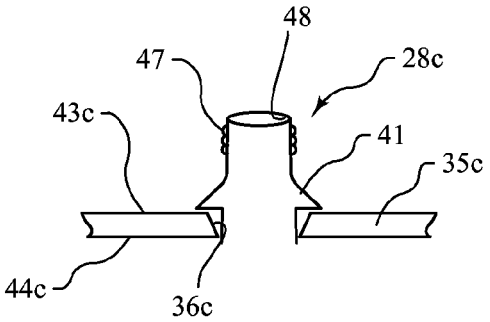
FIG. 8 is another sectional view of a spout that has been inserted through an alternative corner panel and opening, wherein the opening has a larger diameter at the outer surface of the corner panel and a smaller diameter at the inner surface of the corner panel to facilitate pulling the corner spout and flare back through the opening in the corner panel when it is time to replace the stand-up pouch with a new stand-up pouch.
Figure 9:
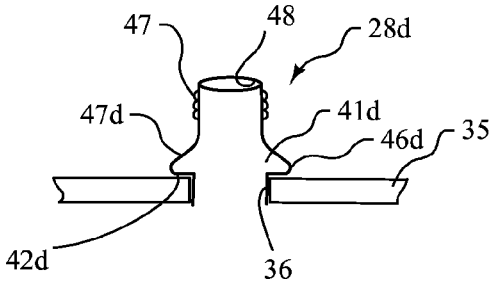
FIG. 9 is another partial sectional view of yet another alternative spout with a rounded flare that has been inserted through the opening in the corner panel.

FIG. 8, on the other hand, illustrates use of the flare 28 first shown in FIG. 5 with an alternative corner panel 35*c* that has a slanted opening 36*c*. Specifically, the opening 36*c* has a diameter at the inner surface 44*c* that is smaller than a diameter of the opening 36*c* at the outer surface 43*c* of the corner panel 35*c*. In this way, the opening 36*c* angles radially outwardly as it extends from the inner surface 44*c* to the outer surface 43*c*. As a result, to remove the spout 28 from its installed position shown in FIG. 8, the spout 28 is pulled downwards in the orientation of FIG. 8 and the larger diameter of the opening 36*c* at the outer surface 43*c* facilitates the passage of the flare 41 through the opening 36*c*. Accordingly, those with poor hand strength can still pull the spout 28 and its flare 41 through the opening 36*c* due to the slanted side wall of the opening 36*c*. Similarly, FIG. 9 illustrates an alternative spout 28*d* that includes a flare 41*d* equipped with a rounded corner 46*d* that is disposed between the slanted wall 47*d* and the bottom edge 42*d* of the flare 41*d*. The rounded corner 46*d* facilitates the pulling of the spout 28*d* downward through the opening 36 in the corner panel 35 so that the stand-up pouch 20 may be more easily removed and replaced with a new stand-up pouch 20.

Figure 10:
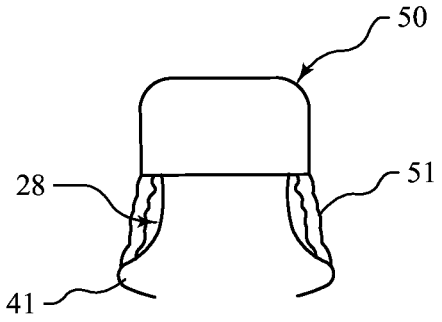
FIG. 10 is a partial side view of a spout of a stand-up pouch that is equipped with a cap and at least one tamper evident tabs.
Figure 11:
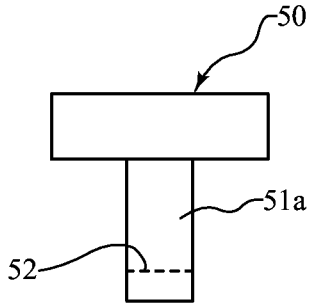
FIG. 11 is a side view of an alternative cap and tamper evident tab, particularly illustrating a score or perforation line that extends through the tab and facilitates the breakage of said tab.
Figure 12:
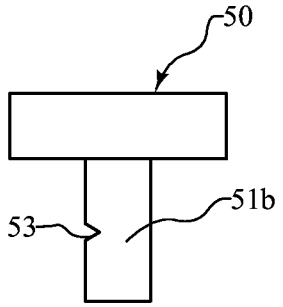
FIG. 12 is an alternative cap and tab to that shown in FIG. 11, particularly illustrating the use of a notch in the tab as opposed to the perforations of FIG. 11.

As shown in FIGS. 5-9 each spout 28, 28*a*, 28*b* and 28*d* may include threads 47 disposed below its distal opening 47. The threads 48 receive a threaded cap 50 as shown in FIGS. 10-12. Because the cap 50 can be removed and replaced, a tamper evident feature ma be advisable or required by regulation. FIG. 10 illustrates a tamper evident mechanism in form of at least one tab 51 that couples the cap 50 to the flare 41. When the cap 50 is unscrewed from the spout 28, the tab 51 breaks, thereby warning the consumer that the cap 50 has been roved from the spout 28. In FIG. 10, the at least one tab 51 either extends around the cap 50 or a plurality of tabs 51 are disposed about the cap 50 and the spout 28 in a spaced-apart fashion. Alternatively, FIG. 11 illustrates a cap 50 with at least one tab 51*a* that includes a line of perforations or a score 52 that extends through the tab 51*a* to facilitate the breaking of the tab 51*a* when the cap 50 is unscrewed from the spout 28. Finally, FIG. 12 illustrates yet another alternative tab 51*b* with a notch 53 that facilitates breakage of the tab 51*b* when the cap 50 is unscrewed from the spout 28.

INDUSTRIAL APPLICABILITY

This document discloses a refillable package that includes a rigid outer container 30 that receives a stand-up pouch 20 having a corner spout 28. The refillable package is extremely useful for consumers as the outer container 30 may be reused and the stand-up pouch 20 may be replaced when its contents become depleted. The outer container 30 includes an open bottom 37 for receiving the stand-up pouch 20. The corner spout 28 may be inserted through an opening 36 in the corner panel 35 of the outer container 30. The spout 28 is pressed through the opening 36 and at least one flare 41 serves to lock or secure the spout 28 and pouch 20 in place within the outer container 30. Removal of the pouch 20 from the container 30 is simple as a flare 41 disposed on the spout 28 may be compressed and the spout 28 pulled back through the opening 36 in the slanted corner panel 35. The outer container 30 may include one or more windows 32, 37*a* for the display of indicia or labeling and the window 37*a* may serve as an indicator for telling the consumer how much product is left in the pouch 20 or provide a warning to the consumer that it is time to purchase a new pouch 20.

White only certain embodiments of been set forth, alternative embodiments and various modifications will be apparent from the above description to those skilled in the art. These and other alternatives are considered equivalents and within the spirit and scope of the present disclosure.

What is claimed:

1. A refillable package comprising:

a pouch having a top with a corner spout;

a hollow shell with an open bottom for receiving the pouch, the hollow shell further including a slanted corner panel with an opening for mateably receiving the corner spout of the pouch;

at least one flare disposed on the corner spout and the opening is sized to frictionally receive the corner spout and flare when inserted through the opening from an interior of the hollow shell to a position outside of the opening; and the opening further being sized to preclude the at least one flare from being pulled back through the opening from the position outside of the opening; and wherein the slanted corner panel has an inner surface and an outer surface and the opening defined by a sidewall extends from the inner to the outer surface, the sidewall having a first diameter at the inner surface and a second diameter at the outer surface that is larger than the first diameter so the sidewall is angled as it extends from the inner surface to the outer surface.

2. The refillable package of claim 1 wherein the opening being sized to frictionally receive the corner spout.

3. The refillable package of claim 1 wherein the hollow shell includes at least one window for exposing indicia printed on the pouch.

4. The refillable package of claim 1 wherein the hollow shell includes at least one window for exposing an amount of product remaining in the pouch.

5. The refillable package of claim 1 wherein the flare is compressible.

6. The refillable package of claim 1 wherein the flare is rounded.

7. The refillable package of claim 1 wherein the pouch is a stand-up pouch with a gusseted bottom.

8. A refillable package comprising:

a pouch having a top with a corner spout;

a hollow shell with an open bottom for receiving the pouch, the hollow shell further including a slanted corner panel with an opening for mateably receiving the corner spout of the pouch;

at least one flare disposed on the corner spout and the opening is sized to frictionally receive the corner spout and flare when inserted through the opening from an interior of the hollow shell to a position outside of the opening; and the opening further being sized to preclude the at least one flare from being pulled back through the opening from the position outside of the opening;

wherein the corner spout further includes a flange spaced apart from the flare for receiving a portion of the slanted corner panel that encircles the opening, the flange having a diameter that is greater than a diameter of the opening.

9. A refillable package comprising:

a pouch having a top with a corner spout;

a hollow shell with an open bottom for receiving the pouch, the hollow shell further including a slanted corner panel with an opening for mateably receiving the corner spout of the pouch;

at least one flare disposed on the corner spout and the opening is sized to frictionally receive the corner spout and flare when inserted through the opening from an interior of the hollow shell to a position outside of the opening; and the opening further being sized to preclude the at least one flare from being pulled back through the opening from the position outside of the opening;

the corner spout includes a distal end that is received in a cap, the cap being connected to the flare by at least one tamper evident tab that breaks when the cap is twisted.

10. The refillable package of claim 9 wherein the tab is scored to facilitate breakage of the tab when the corner spout is inserted through the opening in the corner panel.

11. The refillable package of claim 9 wherein the tab is notched to facilitate breakage of the tab when the corner spout is inserted through the opening in the corner panel.

12. A refillable package comprising:

a stand-up pouch having a top with a slanted corner connected to a corner spout, the stand-up pouch including a gusseted bottom, the corner spout including at least one flare and a flange spaced apart from the flare and disposed between the flare and the slanted corner; and a hollow shell with an open bottom for receiving the stand-up pouch, the hollow shell further including a slanted corner panel with an opening for mateably receiving the corner spout of the stand-up pouch, the slanted corner panel being received between the flare and the flange after the corner spout and flare are inserted through the opening from inside the hollow shell.

13. The refillable package of claim 12 wherein the hollow shell includes at least one window for exposing indicia printed on the stand-up pouch.

14. The refillable package of claim 12 wherein the hollow shell includes at least one window for exposing an amount of product remaining in the stand-up pouch.

15. The refillable package of claim 12 wherein the corner spout includes a distal end that is received in a cap, the cap being connected to the flare by at least one tamper evident tab that breaks when the cap is twisted.

* * * * *